United States Patent [19]

Pidgeon

[11] Patent Number: 4,940,166

[45] Date of Patent: Jul. 10, 1990

[54] METHOD AND APPARATUS FOR APPLYING DECORATIVE COATING MATERIALS TO A SURFACE

[76] Inventor: Webster M. Pidgeon, 158 Webster Ave., Providence, R.I. 02909

[21] Appl. No.: 258,198

[22] Filed: Oct. 14, 1988

[51] Int. Cl.[5] ..... B67D 5/52

[52] U.S. Cl. ..... 222/136; 222/399

[58] Field of Search ..... 222/94, 136, 396, 399, 222/389

[56] References Cited

U.S. PATENT DOCUMENTS

| | | | |
|---|---|---|---|
| 2,925,938 | 2/1960 | Parsons | 222/94 |
| 3,135,428 | 6/1964 | Gallo | 222/136 |
| 3,182,860 | 5/1965 | Gallo | 222/94 |
| 4,386,717 | 6/1983 | Koob | 222/136 |

*Primary Examiner*—H. Grant Skaggs

*Attorney, Agent, or Firm*—Salter & Michaelson

[57] ABSTRACT

A method and apparatus is disclosed for producing an ornamental design on a surface by simultaneously applying a plurality of discrete coating materials of different coloration on the surface. A dispenser is utilized that has a plurality of separate compartments formed therein for receiving the separate discrete coating materials, the coating materials being simultaneously directed under pressure into a nozzle attached to the housing for application onto the surface for producing ornamental multicolor patterns of predetermined design.

1 Claim, 1 Drawing Sheet

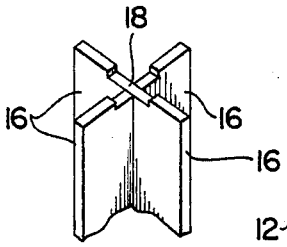
FIG. 3
FIG. 4
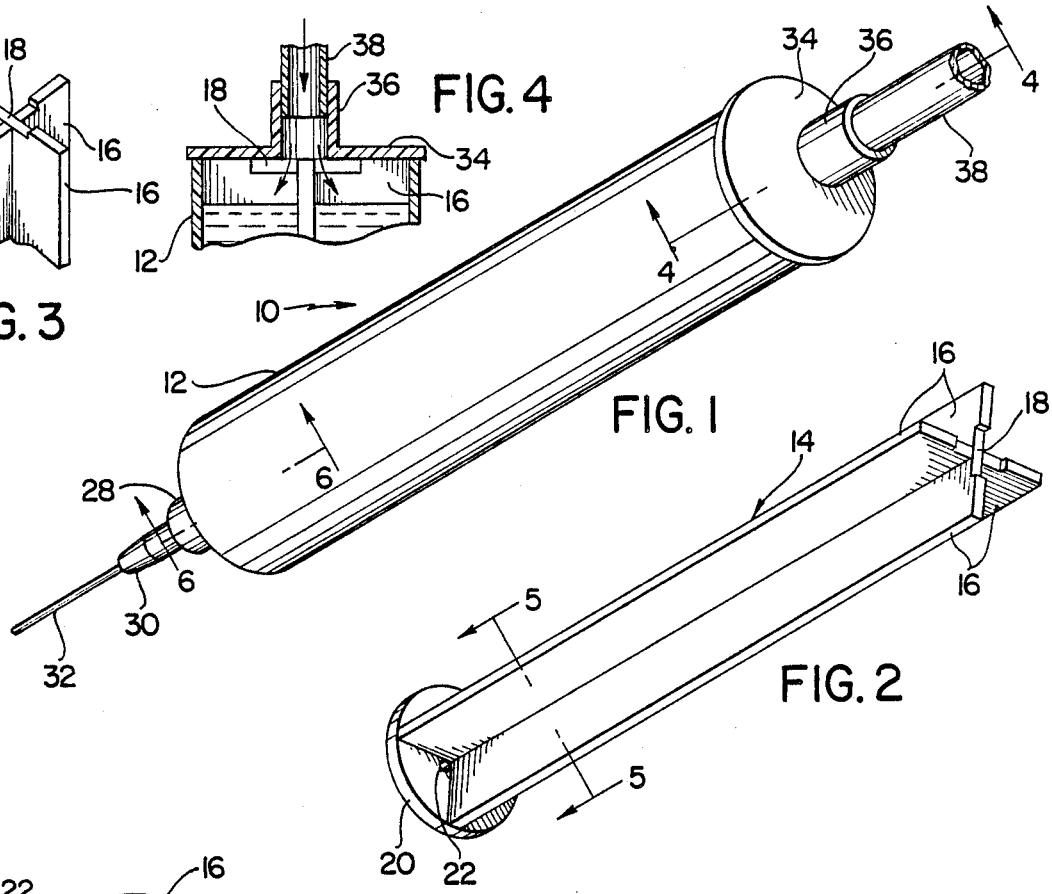
FIG. 1
FIG. 2
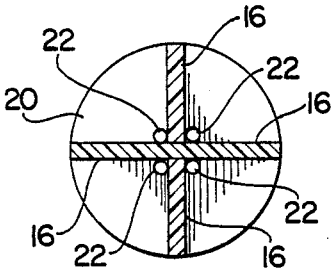
FIG. 5
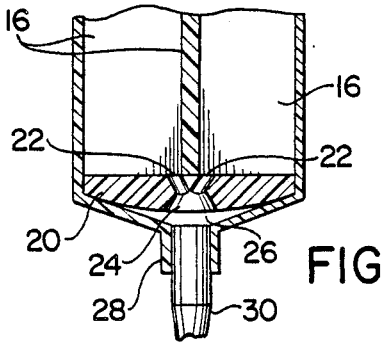
FIG. 6
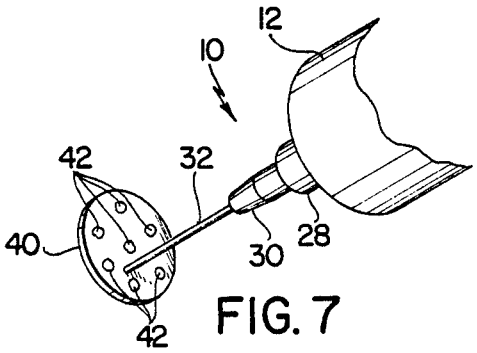
FIG. 7
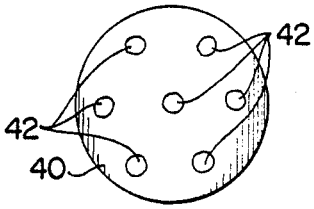
FIG. 8
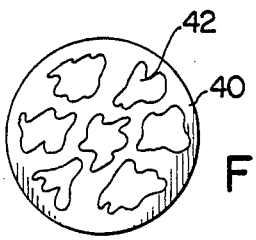
FIG. 9

METHOD AND APPARATUS FOR APPLYING DECORATIVE COATING MATERIALS TO A SURFACE

BACKGROUND OF THE INVENTION

The present invention relates to a method and apparatus for applying decorative coating materials to a surface, and more particularly relates to a method and apparatus for applying epoxy paint of different colorations to the surface of a jewelry finding so as to produce an ornamental design thereon.

The use of epoxy paints on jewelry findings for producing ornamental designs thereon is well known. In carrying out the application of the epoxy paints on jewelry findings, it has been the practice to utilize a dispenser which has an elongated nozzle, the paint being ejected from the dispenser through the nozzle by means of a propellant, such as compressed air. Heretofore, in order to effect different colorations on the jewelry finding, a separate dispenser having a different colored epoxy paint located therein was utilized, the different colored epoxy paint being applied to the jewelry finding in separate operations.

Even with the independent application of the different colored coating materials, the designs produced were not always satisfactory because of the quick-drying characteristics of epoxies that sometimes resulted in run-off of the second-applied material. Further, the extra labor and materials factor in producing designs having different colorations in the prior known uses of epoxy materials resulted in less efficient production and higher costs for producing a particular article.

Applicant is not aware of any other apparatus that could be utilized for applying different colored coating materials to jewelry articles; and apart from the just described apparatus and the technique in the use thereof, the following U.S. patents represent the best prior art known to applicant at the present time relative to the subject invention: U.S. Pat. Nos. 2,746,648; 3,690,515; 3,722,750; 3,813,011; 4,386,717; 3,519,168; 4,526,191 and 4,676,657.

As will be described hereinafter, the present invention avoids the ineffecient and time consuming problems experienced heretofore in the use of epoxy materials for producing various colorations on a jewelry finding and enables interesting design patterns to be produced with a minimum of cost and time involved.

SUMMARY OF THE INVENTION

The present invention relates to an article and method for producing an ornamental design on a surface by simultaneously applying a plurality of discrete coating materials of different coloration on the surface. In order to accomplish the purpose of producing the designs of different coloration in a single application, a unique dispenser is utilized that includes a housing having a plurality of separate compartments formed therein. A dispensing nozzle is attached to the housing and communicates with the compartments, and simultaneously receives the discrete coating materials therein for the dispensing thereof under pressure onto the surface of the finding, multicolor designs thereby being created as desired. In order to dispense the coating materials from the compartments of the dispenser into the nozzle, a source of fluid under pressure is utilized, preferably compressed air, which urges the coating materials into a feed chamber, the feed chamber directing the coating materials into the nozzle for the dispensing thereof onto the finding surface.

Accordingly, it is an object of the present invention to produce an article and to teach a method for simultaneously applying a plurality of discrete coating materials of different coloration onto a surface of an article by the use of a dispenser that includes a housing having separate compartments formed therein in which the different coloration coating materials are located, whereby the coating materials are directed into a nozzle of the dispenser for application onto the surface of the article.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention:

FIG. 1 is a perspective view of the dispenser as embodied in the subject invention;

FIG. 2 is a perspective view of a separator member that is located in the dispenser housing shown in FIG. 1 and that defines a plurality of compartments therewith;

FIG. 3 is a perspective view of the upper portion of the separator members;

FIG. 4 is a sectional view taken along lines 4—4 in FIG. 1;

FIG. 5 is a sectional view taken along lines 5—5 in FIG. 2;

FIG. 6 is a sectional view taken along lines 6—6 in FIG. 1;

FIG. 7 is a perspective view of the lower portion of the dispenser of the subject invention and illustrating the manner in which the globules of coating materials are applied to the surface of an article;

FIG. 8 is an enlarged top plan view of the article on which the coating materials are applied showing a pattern of globules of the coating material after the application thereof; and FIG. 9 is a view similar to FIG. 8 illustrating a design that has been created after the globules have spread over the surface of the article.

DESCRIPTION OF THE PREFERRED EMBODIMENT

Referring now to the drawings and particularly to FIG. 1, a dispenser that is employed for carrying out the purpose of the subject invention is illustrated and is generally indicated at 10. The dispenser 10 includes a housing 12 in which a separator member, generally indicated at 14 in FIG. 2 is located. The separator member 14 is defined by elongated separator elements 16 that are joined together along a central longitudinal axis to define, in effect, two cross pieces that are disposed in perpendicular relation with respect to each other. As shown in FIG. 3, the topmost edge of each of the separator elements 16 has a portion, adjacent to the central axis of the separator member, cutout to define a recessed area indicated at 18. As will be described, the recessed area 18 communicates with the compartments that are defined between the separator elements 16 and the walls of the housing 12 to permit a propelling fluid to be introduced into the compartments for the purpose of expelling the coating materials disposed therein.

Joined to the bottommost end of the separator elements 16 of the separator member 14 is a bottom portion 20 that is circular in configuration and that has a diameter that provides for the bottom portion being received within the housing 12 of the dispenser 10 in snug but slide fitting relation therein. Thus, when the separator member 14 is inserted into the housing 12, the separator elements 16 define a plurality of compartments in the housing, the lower portion 20 of the separator member 14 being received at the bottommost end of the housing 12 in snug fitting relation therein. As shown in FIGS. 5 and 6, the bottom portion 20 is formed with a plurality of small passages 22, each of which is located adjacent to the longitudinal axis of the separator member 14, and in the assembled position of the separator member 14 within the housing 12, each passage 22 communicates with a compartment as defined between two of the separator elements 16 and the interior surface of the housing 12. The passages 22 are formed of a diameter that permit free flow of a coating material therethrough, but are not sufficiently large enough to cause the coating material to produce intermixing of the materials in the compartments, as will be more fully discussed hereinafter. As further illustrated in FIG. 6, the passages 22 communicate with a recess 24, which as will also be described, provides for introduction of the coating materials into a feed chamber 26. Joined to the lowermost end of the feed chamber 26 is a neck section 28 in which a coupling portion 30 of an elongated nozzle or needle 32 is received.

Referring now to FIGS. 1 and 4, a cap 34 is shown mounted on the housing 12, the cap 34 having an upwardly extending neck section 36 joined thereto. Inserted into the neck section 36 is a tube 38 that communicates with a source of a propellant fluid, such as compressed air. With the cap 34 mounted in place over the housing 12, the lower surfaces of the cap 34 engage the uppermost edges of the separator elements 16, wherein the recess 18 is located in direct communication with the interior of the neck section 36 and the tube 38. As compressed air is introduced into the tube 38 and the neck section 36, it will be directed into the recess 18 and then into the upper portions of the separate compartments as defined by the separator elements 16 and the interior walls of the housing 12 and onto the coating materials as contained within the compartments for producing a propelling action thereon.

Prior to the dispensing operation, each of the compartments as defined by the adjacent separator elements 16 is filled with a coating material such as an epoxy paint. Each of the epoxy paints is of a different coloration, and a suitable hardening agent has been introduced into the epoxy material in accordance with the accepted practice to promote the hardening of the paint after it has been applied to a surface. Since epoxy paints are formed in a variety of brilliant colors, any suitable color as required for producing a predetermined pattern can be uiltized. It is also understood that although four compartments are illustrated and described herein, two or three compartments are also contemplated for use depending upon the design that is to be applied to the surface to be ornamented.

As further shown in FIG. 6, the passages 22 as formed in the bottom portion 20 are of a sufficient diameter to permit the flow of the epoxy material therethrough and into the feed chamber 26. However, the passages 22 cannot be overly enlarged so as to permit free flow of the epoxy material therethrough, since overflow of the material could be caused that would result in intermixing of the epoxy materials within the compartments and prior to the dispensing thereof. In this connection, it is contemplated that the passages 22 will have a diameter of approximately 1/32 in. The recess 24 is also limited in the diameter thereof, and it has been found that adequate results can be obtained by limiting the recess 24 to approximately ¼ in.

With the decorative coating materials such as an epoxy paint having been introduced into the various compartments of the housing 12, and with each of the compartments containing a different colored paint material, a source of propelling fluid, such as compressed air, is located in communication with the uppermost end of the housing through the cap 34. Although not shown, the introduction of compressed air into the compartments of the housing 12 is controlled by a suitable valve, such as a foot pedal device. The dispenser 10 is then ready for the application of the coating materials to a surface.

Referring now to FIGS. 7, 8 and 9, a jewelry finding in the form of a circular earring is illustrated therein and is indicated at 40. As described above, the dispenser 10 has particular application in applying the epoxy materials to jewelry findings for producing a finished surface thereon of a predetermined design so as to impart an ornamental appearance thereto. Various kinds of jewelry articles can be decorated in accordance with the subject invention, and the designs as illustrated herein are for illustrative purposes only.

In applying the decorative epoxy coatings to the surface of the article 40, it is understood that as the decorative coatings are expelled from the compartments as formed within the housing 12, they enter the feed chamber 26 for feeding therethrough and into the nozzle 32 for application to the surface of the article 40. However, the coating materials as contained in the separate compartments within the housing maintain their discrete coloration characteristics and do not intermix within the feed chamber 26 or in the nozzle 32 as they are applied to the article 40. Thus, the separate colorations of the coatings are maintained as applied to the surface of the article. In FIG. 7, the nozzle 32 is illustrated adjacent to the surface of the article 40, for the application of the coating materials thereto, globules indicated at 42 of the material being applied in spaced relation thereon. As the globules of material 42 are applied to the surface, they immediately begin to cover the surface, the colorations of the discrete materials maintaining their integrity as the materials begin to spread over the surface of the article. By locating the globules 42 as also shown in FIG. 8 in a predetermined pattern upon the application thereof to the surface of the article 40, predetermined designs can be created. In FIG. 9, a representative design 42 is shown, the colorations that are present as a result of the discrete coatings being maintained and being visible as the surface of the article is coated. Since the needle or nozzle 32 is not utilized for the spreading of the material but only to place the globules of material 42 in position on the surface of the article, placement of the globules in the predetermined pattern is easily accomplished for producing the predetermined design therefrom.

The size of the globules 42 will also determine the appearance of the designs that are created, and this can be controlled by the amount of propellant fluid that is introduced into the compartments of the housing 12. The operator of the device can easily control the compressed air for introduction into the compartments by utilizing the foot pedal control that allows the compressed air to be metered into the compartments thereby permitting the metering of the decorative coating materials out of the compartments through the passages 22, the feed chamber 26 and the nozzle 32.

It is seen that an interesting decorative array can be created on an article of jewelry, such as a finding, each of the discrete ornamental coatings that is utilized maintaining its integrity and color even though concurrently applied with the other coatings as contained in the compartments of the housing 12. The result as produced on the surface of the article are designs that are unusually brilliant in multicolors, and the designs being ornamentally attractive and unusual.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A dispenser for simultaneously applying a plurality of discrete decorative coating materials to a jewelry finding, comprising an elongated cylindrical housing having an upper end and a lower end, an elongated separator member formed of a rigid material, said separator member being located in said housing, said separator member having a central axis and including an axial portion which extends along said axis and a plurality of walls which radiate outwardly from said axial portion and cooperate with said housing to define a plurality of separate compartments, a different colored coating material being located in each of said compartments, a cap mounted on the upper end of said housing, a bottom portion located in said separator member at the lower end thereof and having a relatively small recess formed therein, feed passages of relatively small diameter formed in said bottom portion closely adjacent said axis that provide communication between said recess and said compartments, an elongated small diameter dispensing nozzle mounted on the lower end of said housing and communicating with said recess for receiving the coating materials in unmixed relation therein, said dispensing nozzle having an inlet end and being substantially aligned with said axis, said feed passages being directed substantially toward said inlet end to promote substantially direct flow of said materials from said feed passages to said inlet end and to thereby minimize intermixing of said materials as they pass from said feed passages to said inlet end, and means cooperating with said cap for introducing a fluid medium under pressure into the top of said housing wherein said fluid medium exerts a downward force on said coating materials as located in said compartments to simultaneously force said discrete coating materials into said recess, said coating materials thereafter being directed under pressure into and through said nozzle for application in unmixed discrete colorations onto a surface of a jewelry finding for imparting a decorative multicolor design thereon.

* * * * *